US007510494B2

(12) United States Patent
Morrow et al.

(10) Patent No.: US 7,510,494 B2
(45) Date of Patent: Mar. 31, 2009

(54) NON-SKID LACROSSE BALL

(75) Inventors: David Morrow, Farmington Hills, MI (US); Jesse Hubbard, New York, NY (US); Andrew Maliszewski, Dearborn Heights, MI (US); Matthew Winningham, Birmingham, MI (US)

(73) Assignee: Warrior Sports, Inc., Warren, MI (US)

( * ) Notice: Subject to any disclaimer, the term of this patent is extended or adjusted under 35 U.S.C. 154(b) by 0 days.

(21) Appl. No.: 10/437,837

(22) Filed: May 14, 2003

(65) Prior Publication Data

US 2004/0018901 A1 Jan. 29, 2004

Related U.S. Application Data

(60) Provisional application No. 60/380,530, filed on May 14, 2002.

(51) Int. Cl.
*A63B 37/14* (2006.01)

(52) U.S. Cl. ..... 473/596; 473/600

(58) Field of Classification Search ..... 473/614, 473/613, 280, 378, 383, 595–601, 603, 604, 473/609, 607

See application file for complete search history.

(56) References Cited

U.S. PATENT DOCUMENTS

| | | | | | |
|---|---|---|---|---|---|
| 697,926 | A * | 4/1902 | Richards | 473/378 |
| 4,454,253 | A * | 6/1984 | Murphy et al. | 473/569 |
| 4,789,161 | A * | 12/1988 | Waskelo | 473/594 |
| 5,338,027 | A * | 8/1994 | Rehkemper et al. | 473/613 |
| 5,433,438 | A * | 7/1995 | Gilman | 473/596 |
| 5,549,302 | A * | 8/1996 | Lapsker et al. | 473/573 |
| 6,369,125 | B1 * | 4/2002 | Nesbitt | 473/600 |
| 6,612,948 | B1 * | 9/2003 | Miller | 473/596 |

FOREIGN PATENT DOCUMENTS

| | | | |
|---|---|---|---|
| DE | 2359704 | * | 5/1975 |
| GB | 2292089 A | * | 2/1996 |
| GB | 2314778 A | * | 1/1998 |

* cited by examiner

*Primary Examiner*—Steven Wong
(74) *Attorney, Agent, or Firm*—Warner Norcross & Judd LLP

(57) ABSTRACT

A non-skid lacrosse ball for gripping a lacrosse head and a netting attached to the lacrosse head is provided. The non-skid lacrosse ball is a spherical ball having one or more non-skid surfaces formed substantially thereacross. In one embodiment, the non-skid surface is a textured surface comprised of relatively small surface structures that are integral parts of the spherical ball. Furthermore, both the non-skid surface and the spherical ball are comprised of an elastomer material.

5 Claims, 2 Drawing Sheets

NON-SKID LACROSSE BALL

CROSS-REFERENCE TO RELATED APPLICATIONS

This application claims the benefit of U.S. Provisional Application Ser. No. 60/380,530 filed on May 14, 2002 and entitled "Non-Skid Lacrosse Ball".

TECHNICAL FIELD

The present invention relates generally to a lacrosse ball. More particularly, the present invention relates generally to a lacrosse ball having a non-skid surface for improving a player's control of the lacrosse ball while in the head and while shooting or passing the ball.

BACKGROUND OF THE INVENTION

A lacrosse player typically controls a lacrosse ball in a pocket of a lacrosse head by utilizing the friction between the lacrosse ball and the pocket. This friction allows a player to move the lacrosse ball to a predetermined portion of the pocket. As is known, different portions of the pocket can be utilized to handle or throw the lacrosse ball in various desired ways. For example, one portion of the pocket can be best suited for power-cradling the ball. Also, other portions of the pocket can be best suited for ripping corners or otherwise shooting the lacrosse ball in a particular fashion. In addition to these examples, it is understood that various other portions of the pocket can be particularly suited for a variety of other handling or throwing actions. For the above reasons, control of the lacrosse ball within the pocket clearly is desirable.

Moreover, existing lacrosse balls are formed of a hard rubber or elastomeric material and are smooth over substantially the entire outer surface. This smooth surface can cause skidding or slipping when a lacrosse ball contacts a lacrosse head such as when the ball is being thrown or passed. This is because very little friction exists between a lacrosse ball and a lacrosse head or netting. This is particularly true if the ball or head are wet. As a result, the lacrosse ball may slide across the pocket to a portion of the pocket where the player did not intend to move the ball. This lack of ball control can prevent the player from utilizing specific portions of the pocket that are best suited for the intended throw, cradling, or other action. Further, the tendency of a ball to skid across the scoop of the head can cause erratic shooting or passing.

Therefore, a need exists for a lacrosse ball having a non-skid surface for improving a player's control of the lacrosse ball.

SUMMARY OF THE INVENTION

One advantage of the present invention is to provide a non-skid lacrosse ball that increases friction between the lacrosse ball and a pocket of a lacrosse head.

Another advantage of the present invention is to provide a non-skid lacrosse ball that increases a player's ability to control the movement of the lacrosse ball within a pocket of a lacrosse head.

Still another advantage of the present invention is to provide a non-skid lacrosse ball for improving ball retention when cradling or carrying the lacrosse ball.

Yet another advantage of the present invention is to provide a non-skid lacrosse ball that yields increased accuracy in throwing and shooting the lacrosse ball.

Still another advantage of the present invention is to provide a non-skid lacrosse ball with a substantially low coefficient of drag.

In accordance with the above and the other advantages of the present invention, a non-skid lacrosse ball for gripping a lacrosse head and a netting attached to the lacrosse head is provided. The non-skid lacrosse ball is a generally spherical ball having a plurality of non-skid structures or surfaces formed substantially across the outer surface thereof. In one embodiment, the non-skid structure is a textured surface that is an integral part of the spherical ball. Furthermore, both the non-skid surface and the spherical ball are comprised of an elastomer material.

Other advantages of the present invention will become apparent when viewed in light of the detailed description of the preferred embodiment when taken in conjunction with the attached drawings and appended claims.

BRIEF DESCRIPTION OF THE DRAWINGS

For a more complete understanding of this invention, reference should now be made to the embodiments illustrated in greater detail in the accompanying drawings and described below by way of examples of the invention.

DETAILED DESCRIPTION OF THE PREFERRED EMBODIMENT

Figure 1:
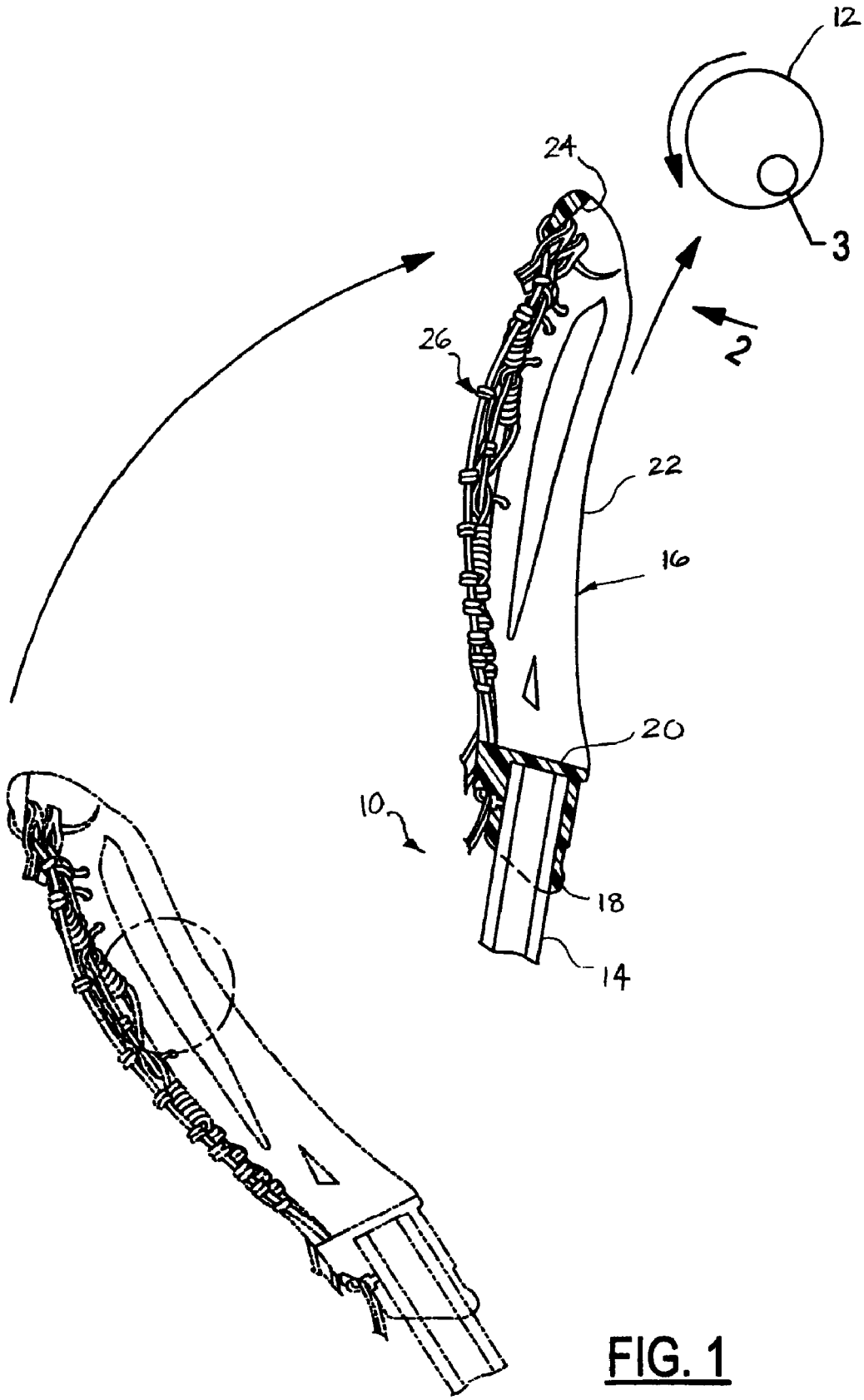
FIG. 1 is a partially cutaway view of a lacrosse head and a non-skid lacrosse ball, illustrating movement of the non-skid lacrosse ball in accordance with one embodiment of the present invention.

In the following figures, the same reference numerals are used to identify the same components in the various views.

Referring to FIG. 1, there are shown a lacrosse stick 10 and a non-skid lacrosse ball 12 thrown from the lacrosse stick 10 according to one embodiment of the present invention. The lacrosse stick 10 includes a lacrosse handle 14 and a lacrosse head 16 attached to the lacrosse handle 14. This lacrosse head 16 is preferably a one-piece frame element including a socket portion 18 for attachment to the lacrosse handle 14, a base portion 20, which acts as a ball rest, adjacent to the socket portion 18, a pair of sidewall portions 22 diverging from the base portion 20, and a scoop portion 24 connecting the top ends of the sidewall portions 22 opposite the base portion 20. Also, a netting 26 is attached to the backside of the scoop portion 24, the base portion 20, and the sidewall portions 22 leaving the front side of the lacrosse head 16 open for receiving a lacrosse ball. This netting 26 forms a pocket for cradling and throwing the lacrosse ball 12. However, it is understood that a variety of other configurations of the lacrosse stick and the lacrosse head may be utilized.

Figure 3:
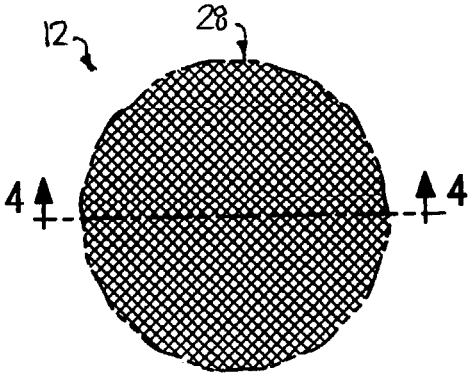
FIG. 3 is a partially cutaway view of the non-skid lacrosse ball shown in FIG. 1, as taken within circle 3, illustrating the non-skid lacrosse ball having a textured surface.

Referring now to FIG. 3, one embodiment of the non-skid lacrosse ball 12 is illustrated. As shown, the lacrosse ball 12 is a generally spherical ball with a non-skid surface 28 formed thereon. In this embodiment, the non-skid surface 28 is a textured surface that is integrally formed thereon such as during the formation of the lacrosse ball. Both the spherical ball and the textured surface are comprised of an elastomer material. However, various other suitable materials can be utilized as desired. This textured surface is intended to contact and grip the netting 26, the various portions of the lacrosse head 16, or any other surface it contacts. In other words, the textured surface is intended to create friction between the lacrosse ball and the lacrosse head or netting and minimize slippage therebetween. Furthermore, the textured surface preferably covers the entire surface area of the spherical ball or at least a substantial portion of the outer surface of the ball. However, it is understood that the textured surface can instead cover one or more smaller areas of the spherical ball as desired. It will also be appreciated that the size and configuration of the textured surface can vary.

Figure 4:
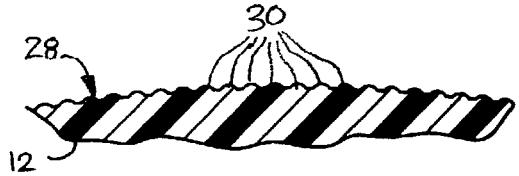
FIG. 4 is a cross-sectional view of the textured surface of the non-skid lacrosse ball shown in FIG. 3, as taken along line 4-4.

As illustrated in FIG. 4, in one embodiment, the textured surface constitutes an unevenness or pattern in the surface of the spherical ball. In this respect, the textured surface can be a series of relatively small surface structures 30 that are integral parts of the spherical ball and that extend generally outwardly therefrom. Moreover, as shown, the structures 30 are preferably uniformly spaced across the surface of the ball. Because the structures 30 protrude from the ball surface, surrounding valleys 32 are left between adjacent structures 30. The uniformity of the structures 30 across the surface can obviously vary such that each structure is not uniformly spaced, but that the surface is divided up into sections, which in themselves are uniformly organized with respect to one another. Alternatively, it is contemplated that the textured surface can instead be a separate coating that is applied to an otherwise smooth spherical ball by way of an overmolding process or other suitable manufacturing or post-manufacturing processes.

Figure 5:
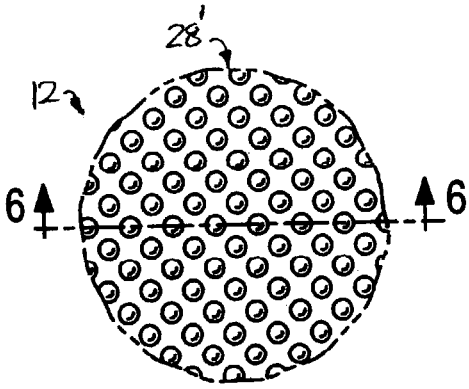
FIG. 5 is a schematic illustration of a non-skid lacrosse ball having a textured surface formed thereon, in accordance with another embodiment of the present invention.
Figure 6:
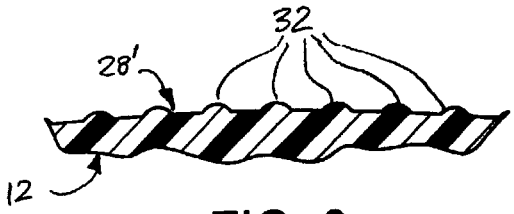
FIG. 6 is a cross-sectional view of the non-skid lacrosse ball shown in FIG. 5, as taken along line 6-6.

FIGS. 5 and 6 illustrate another embodiment of a non-skid lacrosse ball in accordance with the present invention. As shown, the lacrosse ball 12 is a generally spherical ball with a non-skid surface 28'. In this embodiment, the non-skid surface 28' of the spherical ball is a plurality of nubs 32 that extend outwardly from the surface of the spherical ball. These nubs 32 are integral parts of the spherical ball that extend therefrom and which are preferably formed during the manufacturing process. However, similar to the above, these nubs 32 can instead be parts of a separate coating that are applied to the spherical ball by an overmolding process or other suitable manufacturing or post-manufacturing processes. However, the nubs 32 in this embodiment are larger and protrude a further distance than the surface irregularities discussed above in connection with FIGS. 3 and 4. Moreover, as shown, the nubs 32 are preferably uniformly spaced across the surface of the ball. Because the nubs 32 protrude from the ball, surrounding valleys 34 are formed between adjacent nubs 32. The uniformity of the nubs 32 across the surface can obviously vary.

In addition to the above embodiments, it is contemplated that a variety of other constructions or applications can provide the non-skid lacrosse ball 12 with a surface that can grip the netting 26 or the various portions of the lacrosse head 16.

The non-skid lacrosse ball 12 is intended to improve a player's control over the movement of the lacrosse ball 12 within the pocket. This ball control is beneficial because it increases the player's ability to retain the ball 12 within the pocket and also increases his accuracy in throwing or shooting the lacrosse ball 12. Moreover, the textured surface provides improved aerodynamic characteristics by helping to improve accuracy without significantly increasing drag.

Specifically, the non-skid lacrosse ball 12 grips the netting 26, the base portion 20, the sidewall portions 22, the scoop portion 24, and any other surface it contacts. The friction between the lacrosse ball 12 and the netting 26 allows a player to move the lacrosse ball 12 to a desired portion of the pocket. As is known, one or more specific portions of the pocket can be better suited for cradling than they are for throwing. On the other hand, it is also understood that other portions of the pocket can be better suited for throwing than they are for cradling. Accordingly, the non-skid lacrosse ball 12 allows a player to move the ball 12 to a portion of the pocket that is best suited for performing the desired action, e.g. cradling or throwing. It will be appreciated that the different portions of the pocket can be suited for other actions besides cradling or shooting.

Figure 2:
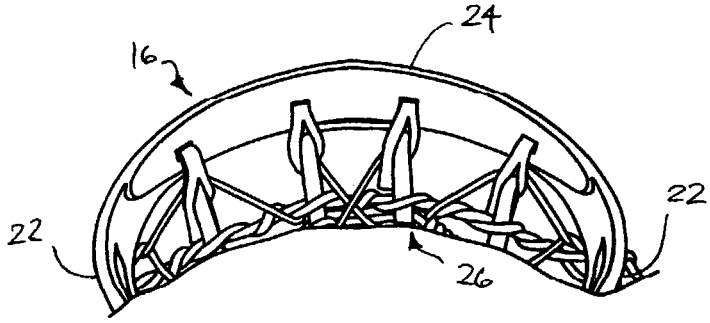
FIG. 2 is a cutaway view of a scoop portion of the lacrosse head shown in FIG. 1, as taken from the perspective of arrow 2.

Furthermore, as shown in FIGS. 1 and 2, it will be appreciated that the friction between the lacrosse ball 12 and the netting 26 and the scoop portion 24 can impart spin on the lacrosse ball 12 as it is released from the lacrosse head 16. This ball spin is beneficial because it can decrease the amount of drag forces on the ball 12 as it travels through the air thereby preserving the ball's airspeed. In addition, it is also understood that the ball spin can cause the ball to travel along a relatively straight path and improve the accuracy of the player's throwing or shooting.

While particular embodiments of the invention have been shown and described, numerous variations and alternate embodiments will occur to those skilled in the art. Accordingly, it is intended that the invention be limited only in terms of the appended claims.

What is claimed is:

1. A non-skid lacrosse ball, comprising:

a solid spherical ball having a raised textured surface formed thereon, the raised textured surface configured to frictionally engage and grip a lacrosse netting secured to a lacrosse head so that the ball is substantially restricted from sliding across the netting, wherein the raised textured surface reduces aerodynamic drag on the ball in flight after the ball leaves the lacrosse head;

wherein said solid spherical ball and said raised textured surface consist of an elastomer material, wherein said solid spherical ball has a uniform distribution of the elastomer material throughout substantially all cross sections of the lacrosse ball in the finished form of the lacrosse ball, wherein said solid spherical ball and said raised textured surface are void of any distinguishable variations in the elastomer material in the cross sections of the finished form of the lacrosse ball, wherein the solid spherical ball is void of a separate exterior cover in the finished form of the lacrosse ball, wherein said raised textured surface is slightly raised with respect to an adjacent surface of said solid spherical ball, wherein said solid spherical ball is sized to be caught and thrown by said lacrosse head, wherein the raised textured surface is configured to frictionally engage at least one of a scoop and a pocket of the lacrosse head when shooting the lacrosse ball therefrom so that such frictional engagement imparts spin to said solid spherical ball, wherein said raised textured surface extends substantially around the entire periphery of said spherical ball, wherein said raised textured surface and said spherical ball are formed of an integrated material.

2. The non-skid lacrosse ball of claim 1 wherein said raised textured surface includes a plurality of nubs that extend generally outwardly from said solid spherical ball.

3. The non-skid lacrosse ball of claim 2 wherein said plurality of nubs is uniformly spaced across said solid spherical ball.

4. The non-skid lacrosse ball of claim 1 wherein said raised textured surface includes a series of partial spheroid protrusions that extend generally outwardly from said solid spherical ball.

5. The non-skid lacrosse ball of claim 4 wherein said series of partial spheroid protrusions is uniformly spaced across said solid spherical ball.

* * * * *